US012246870B2

(12) United States Patent
Sahin et al.

(10) Patent No.: US 12,246,870 B2
(45) Date of Patent: Mar. 11, 2025

(54) CUTTING, CRIMPING AND STACKING MACHINE FOR CONICAL CORNET CONE PACKAGES

(71) Applicant: Mondi Kale Nobel Ambalaj Sanayi Ve Ticaret Anonim Sirketi, Kirklareli (TR)

(72) Inventors: Umit Sahin, Kirklareli (TR); Osman Kadiroglu, Kirklareli (TR)

( * ) Notice: Subject to any disclaimer, the term of this patent is extended or adjusted under 35 U.S.C. 154(b) by 259 days.

(21) Appl. No.: 17/771,731

(22) PCT Filed: Dec. 23, 2019

(86) PCT No.: PCT/TR2019/051184
§ 371 (c)(1),
(2) Date: Apr. 25, 2022

(87) PCT Pub. No.: WO2021/096452
PCT Pub. Date: May 20, 2021

(65) Prior Publication Data

US 2023/0002094 A1 Jan. 5, 2023

(30) Foreign Application Priority Data

Nov. 15, 2019 (TR) ..... 2019/17817

(51) Int. Cl.
*B65B 35/50* (2006.01)
*B65B 5/02* (2006.01)
*B65B 61/06* (2006.01)

(52) U.S. Cl.
CPC ..... *B65B 35/50* (2013.01); *B65B 5/02* (2013.01); *B65B 61/06* (2013.01)

(58) Field of Classification Search
CPC ..... B65B 5/02; B65B 31/50; B65B 61/06
See application file for complete search history.

(56) References Cited

U.S. PATENT DOCUMENTS 2,194,275 A * 3/1940 Carew ..... B31B 50/00 493/55
2,240,501 A * 5/1941 Greenhill ..... B31B 70/00 493/151
2,902,232 A * 9/1959 Jacobsen ..... D06C 3/00 188/110
3,065,676 A * 11/1962 Loeser ..... B31B 50/34 74/380

(Continued)

FOREIGN PATENT DOCUMENTS

DE 3314586 A1 * 9/1984 ..... B31B 25/60
DE 3631129 A1 * 3/1987 ..... G03G 15/00

(Continued)

OTHER PUBLICATIONS

International Search Report for corresponding PCT/TR2019/051184, dated Aug. 13, 2020.

(Continued)

*Primary Examiner* — Thomas M Wittenschlaeger
*Assistant Examiner* — David G Shutty
(74) *Attorney, Agent, or Firm* — Egbert, McDaniel & Swartz, PLLC

(57) ABSTRACT

A cutting, crimping and stacking machine that is capable of performing automatically cutting, crimping and stacking conical cornet cone packages by itself.

7 Claims, 2 Drawing Sheets

(56) References Cited

U.S. PATENT DOCUMENTS

| | | | | | |
|---|---|---|---|---|---|
| 3,391,617 | A * | 7/1968 | Wise | B65D 85/78 | 493/149 |
| 3,487,443 | A * | 12/1969 | Wise | B65D 85/78 | 426/130 |
| 4,008,649 | A * | 2/1977 | Shikaya | B31C 1/083 | 425/336 |
| 5,772,197 | A * | 6/1998 | Aoki | G03G 15/6538 | 270/58.08 |
| 6,200,406 | B1 * | 3/2001 | Ito | B31B 50/00 | 156/250 |
| 6,312,370 | B1 * | 11/2001 | Allmon | B65D 3/06 | 229/184 |
| 6,514,185 | B1 * | 2/2003 | Knuppertz | B31B 50/00 | 493/295 |
| 7,682,299 | B2 * | 3/2010 | Veciana Membrado | B31B 70/00 | 229/87.08 |
| 10,398,242 | B2 * | 9/2019 | Bonney | B31C 7/06 | |
| 2017/0137157 | A1 * | 5/2017 | Irwin | B65B 59/001 | |

FOREIGN PATENT DOCUMENTS

| | | | | |
|---|---|---|---|---|
| EP | 1864791 | B1 | 8/2008 | |
| IT | M910153 | A1 | 7/1992 | |
| TR | 2017/08349 | A1 | 6/2017 | |
| WO | WO-0110634 | A1 * | 2/2001 | B31C 7/08 |

OTHER PUBLICATIONS

Written Opinion of the International Searching Authority for corresponding PCT/TR2019/051184, dated Aug. 13, 2020.

* cited by examiner

CUTTING, CRIMPING AND STACKING MACHINE FOR CONICAL CORNET CONE PACKAGES

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A READ-ONLY OPTICAL DISC, AS A TEXT FILE OR AN XML FILE VIA THE PATENT ELECTRONIC SYSTEM

Not applicable.

STATEMENT REGARDING PRIOR DISCLOSURE BY THE INVENTOR OR A JOINT INVENTOR

Not applicable.

BACKGROUND OF THE INVENTION

1. Field of the Invention

The invention relates to the production of conical cornet cone packages in which ice cream is placed.

The invention particularly relates to a machine which is capable of performing automatically the cutting, crimping and stacking processes of conical cornet cone packages by itself.

2. Description of Related Art Including Information Disclosed Under 37 CFR 1.97 and 37 CFR 1.98

Today, the cornet cone packages are used to present ice creams to consumers. As described in EP186479B1 publication numbered European Patent, the cornet cone packages are currently produced after the four different stage process. At the first stage, the plane package roller that is progressing like a carpet with its special blade structure is divided into special-shaped strips.

The roller divided into special-shaped strips comes out of the machine in two ways, namely reverse and straight ways. The strip, which comes out in reverse way at the second stage, is made ready for the cutting machine by being turned via a reversing machine. At the third stage, the prepared rollers are cut in one move and transferred to the crimping machine and then at the fourth stage, the pieced coming out of the cutting machine are crimped quickly and transformed into cornet cone package.

EP1864791B1 publication numbered European Patent relates to a method for the manufacturing of conical ice cream packages. By means of mentioned method, at the first cutting process, the upper band and lower band are obtained and following this process, the second cutting process is performed in order to obtain separate trapezoidal cuts, finally with the third cutting process carried out on the helical edge of the cut, thus a package showing conical expansion is formed by obtaining a circular edge having a single radius of curvature.

U.S. Pat. No. 2,194,275 (A) publication numbered patent also relates to a different method for the production of conical ice cream package.

TR2017/08349 numbered patent application also relates to a high speed cornet crimping machine having a high production capacity and a mechanic-independent motion control system, which comprises at least one feeding apparatus transferring the papers alternately to the conveying apparatus, the feeding apparatus engines providing drive motion to the feeding magazine, the conveying apparatus driving the papers coming from feeding magazine to the transfer line, the transfer line transferring the papers coming from the conveying apparatus to the tip crimping unit as standard and the tip crimping units providing the tips of the product are crimped inwardly in a standard way. However, the related machine provides that the packing papers are only crimped and the cutting and stacking processes are performed manually by the operators. The cornet pieces to be crimped are stacked one on the top of the other and are going into the crimping machine quickly like a charger and then form the cornet package by being crimped. In other words, in the mentioned patent, the pieces to be made cone are stacked manually in a chamber and fed from there to the machine.

Consequently, the need for a machine that is capable of automatically cutting, crimping and stacking the conical cornet cone packages by itself and the inadequacy of the existing solutions necessitated an improvement in the related technical field.

BRIEF SUMMARY OF THE INVENTION

The main object of the invention is to develop a machine which is capable of automatically cutting, crimping and stacking the conical cornet cone packages by itself.

Another object of the invention is to increase production rate of the conical cornet cone packages by means of automatically performing the cutting, crimping and stacking processes.

Another object of the invention is to make the process completely continuous and automatic by eliminating the manual processes (stacking, etc.) during the production process of the conical cornet cone packages. It is to eliminate the additional labour force for manual operations (operator, etc.).

Another object of the invention is to stack the pieces to be made cone to chamber in the prior art and then feed them from there to the machine. The pieces to be made cone in the machine according to the invention are cut directly from the roller and transferred to the crimping machine. Therefore, by eliminating the feeding process between these two process processes, the production rate has been increased and the labour force has been decreased.

REFERENCE NUMBERS

Figure 1:
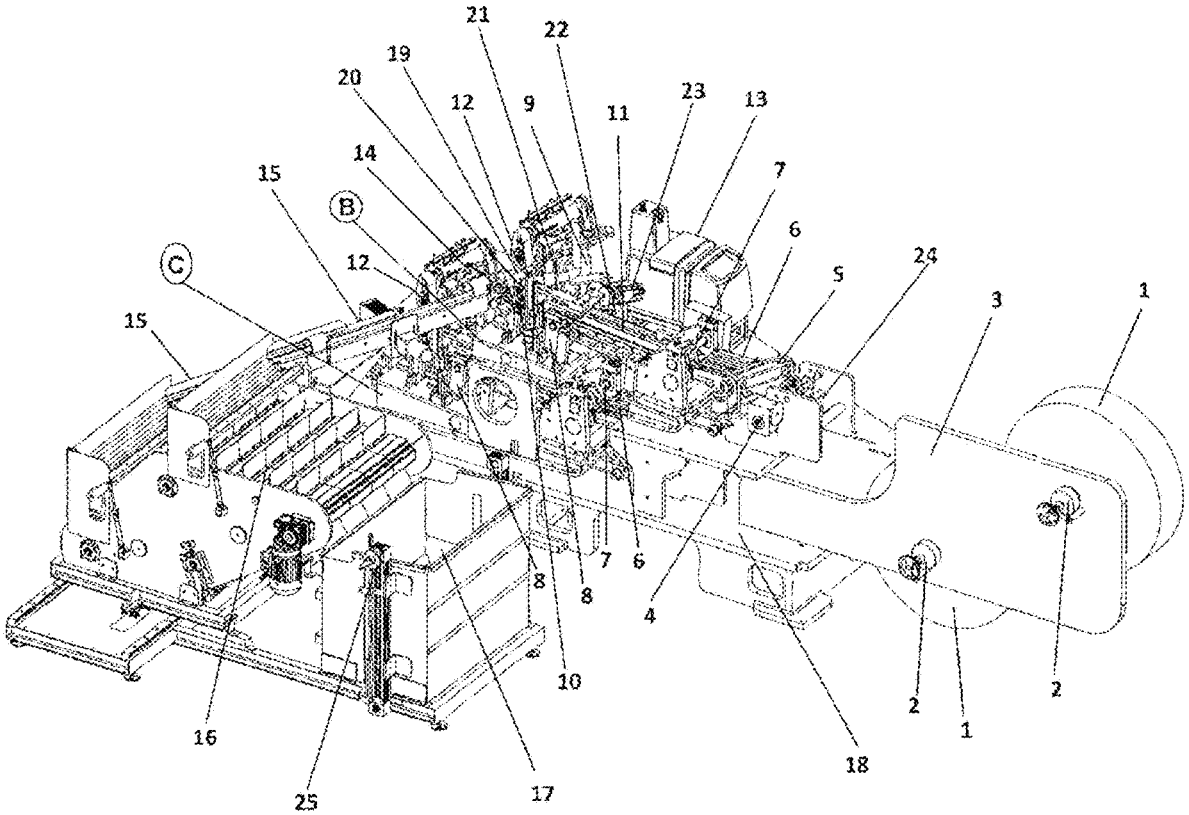
FIG. 1 is a perspective view of the cutting, crimping and stacking machine according to the invention.

A. Cutting, crimping and stacking machine
B. First unit
C. Second unit
1. Semi-finished roller
2. Braking system
3. Tensioning (dancer) system
4. Product traction cylinder
5. Product cutting unit
5.1. Rotating roller
6. Product transfer conveyor
7. half-moon reel
8. Paper transfer unit
9. Product crimper unit
10. Glue injector
11. Transfer rails
12. Moving sawdust blade system
13. Glue preparing tank
14. Product tip crimping unit
15. Crimped product counter conveyor
16. Output product transferring and collecting conveyor
17. Moving product collecting chamber
18. Frame
19. Upper crimper conical mold
20. Lower crimper conical mold
21. Sawdust suction pipe
22. On-off servo motor
23. Drive servo motor
24. Cutting positioning sensor
25. Product collecting chamber movement system

DETAILED DESCRIPTION OF THE INVENTION

The invention relates to a cutting, crimping and stacking machine (A) that is capable of performing automatically cutting, crimping and stacking the conical cornet cone packages by itself. The cutting, crimping and stacking machine (A) according to the invention is comprised of two units, namely a first unit (B) and a second unit (C), which have the same working principle, consist of the same elements and can operate independently of each other simultaneously. Provided that the working principle remains the same, the number of units can be increased and decreased depending on need and demand.

The loading process of semi-finished rollers (1) to the air shaft and electro-magnetic brake system (2) is performed separately by the operator. Then, by performing air locking, the semi-finished rollers (1) are secured in a rotatable way. The products coming out of the semi-finished roller (1) are passed through the tensioning (dancer) system (B) and compressed by hand between the product traction cylinders (4) in a pressed way. By measuring the tension between the dancer and the shaft with the electromagnetic brake system (2) and also the roller diameter with sensor, the brake is applied at variable moment value. As the machine rotates, the product, which is opened in proper and oriented way from semi-finished roller (1) automatically by the product traction cylinder (4), is passed through the product cutting unit (5) and cutting process is carried out into the desired dimensions.

Figure 2:
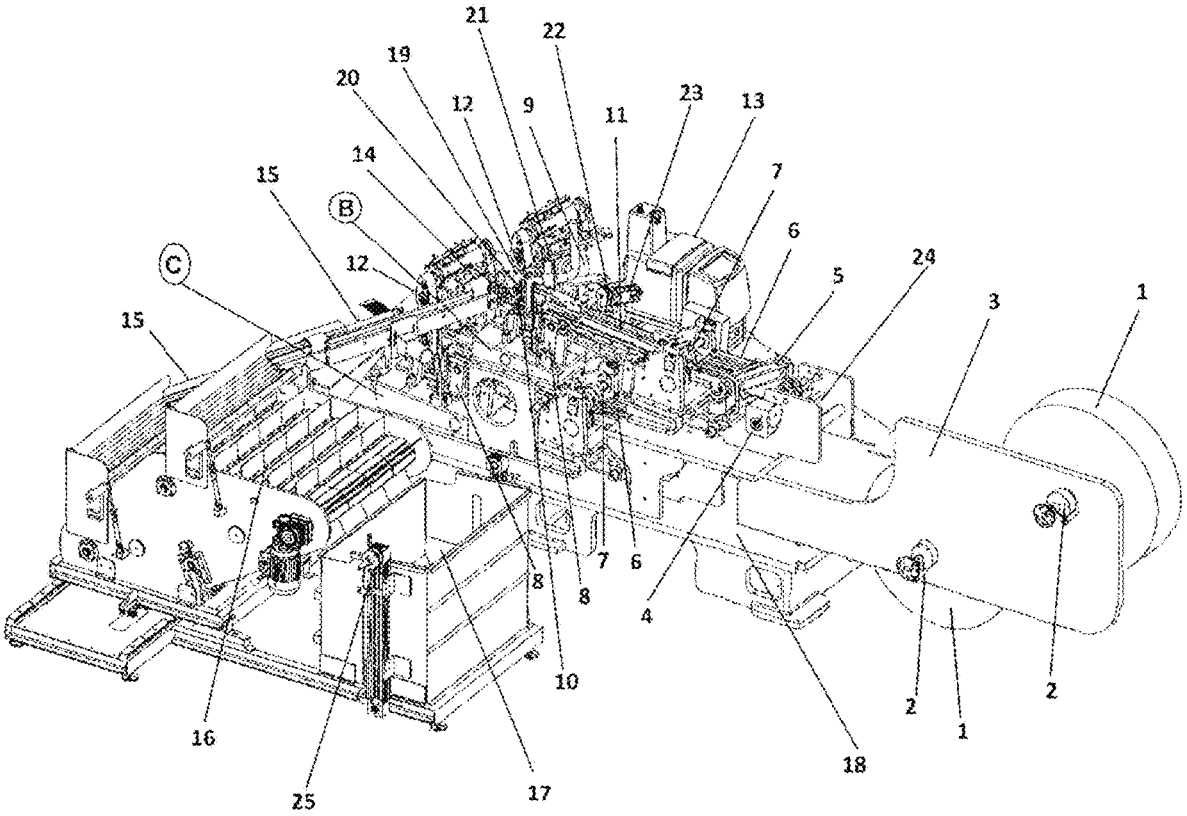
FIG. 2 is a detailed perspective view of the product cutting unite.

In FIG. 2, the detailed perspective view of the product cutting unit (5) has been given. As seen in the figure, the product cutting unit (5) comprises at least one rotating roller (5.1) in which the blade cutting the package strip is placed. The package strip coming from semi-finished roller (1) is separated into the suitable pieces for the production of cornet cone in one move. The blade on the rotating roller (5.1) cuts the package strip at each turn. The speed of the rotating roller (5.1) can be increased and decreased according to the type and dimension of the cornet cone to be cut. Before the products enters into the product traction cylinder (4), the length of the products passed through the cutting positioning sensor (24) is measured and the traction amount is controlled and the cutting length is adjusted in this way. Then, the cornet papers, which are cut into desired size, are transferred to the crimping section by the product transfer conveyor (6). The accurate cutting process is achieved by synchronizing the accordance of the pattern and cut-off position on the paper and the position that the product traction cylinder (4) obtains with the servo motor from the cutting positioning sensor (24). The product cutting unit (5) operates by communicating with the product crimper unit (9) and the cut products are transferred to the paper transfer unit (8) by the half-moon reel (7) at the appropriate time while leaving out from the product transfer conveyor (6).

The position indicated as appropriate time information is the position of half-moon reel (7) on the product transfer conveyor (6) with respect to the product The products are transferred to the paper transfer unit (8) by the half-moon reel (7). The carrier feet situated on the paper transfer unit (8) start to transfer the products to the product crimper unit (9) by stacking the products in an equally spaced manner at a certain distance (until the product arrives at the crimper unit (9)). During this transferring process, the products are positioned relative to the upper crimper conical mold (19) and the lower crimper conical mold (20) by the transfer rails (11).

The products, which are positioned close to the product crimper unit (9) and in a certain range, are glued to the inner side of the products having the desired properties with the glue injector (10) just before entering the unit. The required glue is stored in a glue preparing tank (13). Then, the products that come in front of the product crimper unite unit (9) are vacuumed by the upper crimper conical mold (19) and the products taken over the paper transfer unit (8) are crimped between the two molds by the help of the lower crimper conical mold (20) and at the same time they are attached, so the crimping process is performed. During this crimping process, the upper crimper conical mold (19) and the lower crimper conical mold (20) turn around in the axis of the drive servo motor (23). During this crimping process, the excess sawdust arising from the opening part of the product is cut by the moving sawdust blade system (12) on the upper crimper conical mold (19). The cut sawdusts are suctioned by the sawdust suction unit (21) and discharged. After the crimping and sawdust cutting process are completed, the lower crimper conical mold (20) is opened by the on-off servo motor (22) and the products are thrown to the crimped product counter conveyor (15) by the upper crimper conical mold (19). In this way, crimped cornet packages are obtained and the production circle is continuously repeated.

Since the cutting, crimping and stacking machine (A) according to the invention contains a first unit (B) and a second unit (C), these processes are performed twice per unit time. These systems operate independently of each other. The products coming from the crimped product counter conveyor (15) are collected at the output product transferring and collecting conveyor (16). The products transferred by the output product transferring and collecting conveyor (16) are collected by stacking at desired amounts in the moving product collecting chamber (17). As the bottom of the moving product collecting chamber (17) is filled by the product collecting chamber movement system (25), it is lowered.

The invention claimed is:

1. A cutting, crimping and stacking apparatus for automatically cutting, crimping and stacking conical cornet cone packages from products, the cutting, crimping and stacking apparatus comprising:

a first product cutting unit having an rotatable semi-finished roller, said first product cutting unit having a product traction cylinder and a blade, said first product cutting unit adapted to open the product by the rotatable semi-finished roller and to pass the opened product by the product traction cylinder and to cut the opened product into a desired dimension by the blade;

a second product cutting unit having a rotatable semi-finished roller, wherein said second product cutting unit has a product traction cylinder and a blade, the second product cutting unit adapted to open another product by the rotatable semi-finished roller of the second product cutting unit and to pass the opened product by the product traction cylinder of the second product cutting unit so as to be cut into a desired dimension by the blade;

a first cutting position sensor that controls an amount of traction by measuring a length of the product prior to entering into the product traction cylinder of said first product cutting unit so as to adjust a cutting length;

a second cutting position sensor that controls an amount of traction by measuring a length of the another product prior to entering into the product traction cylinder of said second product cutting unit so as to adjust another cutting length;

a first paper transfer unit that is adapted to transfer the cut product;

a second paper transfer unit that is adapted to transfer the cut another product;

a first glue injector adapted to glue the cut product from said first paper transfer unit at an inner side of the product;

a second glue injector adapted to glue the cut another product from said second paper transfer unit at an inner side of the another product;

a first upper crimper conical mold adapted to vacuum the glued product coming in from said first paper transfer unit;

a second upper crimper conical mold adapted to vacuum the glued another product coming in from said second paper transfer unit;

a first lower crimper conical mold adapted to crimp the product by compressing the glued product between said first upper crimper conical mold and said first lower crimper conical mold;

a second lower crimper conical mold adapted to crimp the another product by compressing the glued another product between said second upper crimper conical mold and said second lower crimper conical mold;

a first on-off servomotor cooperative with said first lower crimper conical mold so as to open said first lower crimper conical mold away from said first upper crimper conical mold after compressing the glued product;

a second on-off servomotor cooperative with said second lower crimper conical mold so as to open said second lower crimper conical mold away from said second upper crimper conical mold after compressing the glued another product;

a first crimped product counter conveyor cooperative with said first upper crimper conical mold so as to receive the crimped product from said first upper crimper conical mold after the first lower crimper conical mold is opened;

a second crimped product counter conveyor cooperative with said second upper crimper conical mold so as to receive the crimped another product from said second upper crimper conical mold after the second lower crimper conical mold is opened, wherein said first product cutting unit and said first cutting position sensor and said first paper transfer unit and said first glue injector and said first upper crimper conical mold and said first lower crimper conical mold and said first on-off servomotor and said first crimped product counter conveyor are arranged in parallel with said second product cutting unit and said second cutting position sensor and said second paper transfer unit and said second glue injector and said second upper crimper conical mold and said second lower crimper conical mold and said second on-off servomotor and said second crimped product counter conveyor so as to pass the crimped product and the crimped another product as an output therefrom;

a single product transfer and collecting conveyor cooperative with said crimped product counter conveyor so as to collect the crimped product and the crimped another product from the output of said first crimped product counter conveyor and said second crimped product counter conveyor; and a single moving product collecting chamber cooperative with said single product transfer and collecting conveyor so as to stack the collected crimped product and the collected crimped another product from said single product transfer and collecting conveyor.

2. The cutting, crimping and stacking apparatus of claim 1, wherein each of said first product cutting unit and said second product cutting unit has an air shaft and an electromagnetic brake system, the rotatable semi-finished roller of each of said first product cutting unit and said second product cutting unit being loaded in said the air shaft and the electromagnetic brake system.

3. The cutting, crimping and stacking apparatus of claim 1, each of said first product cutting unit and said second product cutting unit having a tensioning system positioned between the rotatable semi-finished roller and the product traction cylinder.

4. The cutting, crimping and stacking apparatus of claim 1, wherein each of said first paper transfer unit and said second paper transfer unit has a half-moon reel adapted to transfer the product and the another product respectively to said first paper transfer unit and said second paper transfer unit.

5. The cutting, crimping and stacking apparatus of claim 1, further comprising:

a first moving sawdust blade system positioned adjacent said first product cutting unit and adapted to remove excess sawdust from the opened product, said first moving sawdust blade system connected to said first upper crimper conical mold so as to rotate said first upper crimper conical mold; and a second moving sawdust blade system positioned adjacent said second product cutting unit and adapted to remove excess sawdust from the opened another product, said second moving sawdust blade system connected to said second upper crimper conical mold so as to rotate adjacent first upper crimper conical mold.

6. The cutting, crimping and stacking apparatus of claim 5, further comprising:

a first sawdust suction unit cooperative with said first moving sawdust blade system so as to suction the removed excess sawdust from said first moving sawdust blade system; and a second sawdust suction unit cooperative with said second moving sawdust blade system so as to suction the removed excess sawdust from said second moving sawdust blade system.

7. The cutting, crimping and stacking apparatus of claim 1, further comprising:

a single product collecting chamber movement system cooperative with said single moving product collecting chamber so as to lower a bottom of said single moving product collecting chamber as the crimped product and the crimped another product are collected in said single moving product collecting chamber.

* * * * *